US005730837A

United States Patent [19]

Black et al.

[11] Patent Number: 5,730,837

[45] Date of Patent: Mar. 24, 1998

[54] METHOD OF SEPARATING LIGNOCELLULOSIC MATERIAL INTO LIGNIN, CELLULOSE AND DISSOLVED SUGARS

[75] Inventors: Stuart K. Black, Denver; Bonnie R. Hames, Westminster; Michele D. Myers, Dacono, all of Colo.

[73] Assignee: Midwest Research Institute, Kansas City, Mo.

[21] Appl. No.: 348,469

[22] Filed: Dec. 2, 1994

[51] Int. Cl.[6] ..... D21C 3/20

[52] U.S. Cl. ..... 162/16; 162/72; 162/77; 127/37

[58] Field of Search ..... 162/72, 76, 77, 162/29, 16; 127/37

[56] References Cited

U.S. PATENT DOCUMENTS

| | | | |
|---|---|---|---|
| 1,594,389 | 8/1926 | Theillier . | |
| 1,888,025 | 11/1932 | Bent . | |
| 2,024,689 | 12/1935 | Groombridge . | |
| 2,037,001 | 4/1936 | Aronovsky . | |
| 2,042,705 | 6/1936 | Dreyfus . | |
| 3,585,104 | 6/1971 | Kleinert | 162/77 |
| 3,932,207 | 1/1976 | Fogarassy . | |
| 3,951,734 | 4/1976 | DeHaas | 162/72 |
| 4,520,105 | 5/1985 | Sinner . | |
| 4,594,130 | 6/1986 | Chang . | |

FOREIGN PATENT DOCUMENTS 0211558 of 1987 European Pat. Off. .

*Primary Examiner*—Steven Alvo
*Attorney, Agent, or Firm*—Edna M. O'Connor; Ruth Eure

[57] ABSTRACT

A method for separating lignocellulosic material into (a) lignin, (b) cellulose, and (c) hemicellulose and dissolved sugars. Wood or herbaceous biomass is digested at elevated temperature in a single-phase mixture of alcohol, water and a water-immiscible organic solvent (e.g., a ketone). After digestion, the amount of water or organic solvent is adjusted so that there is phase separation. The lignin is present in the organic solvent, the cellulose is present in a solid pulp phase, and the aqueous phase includes hemicellulose and any dissolved sugars.

8 Claims, No Drawings

METHOD OF SEPARATING LIGNOCELLULOSIC MATERIAL INTO LIGNIN, CELLULOSE AND DISSOLVED SUGARS

CONTRACTUAL ORIGIN OF THE INVENTION

The United States Government has rights in this invention under Contract No. DE-AC36-83CH10093 between the United States Department of Energy and the National Renewable Energy Laboratory, a Division of the Midwest Research Institute.

BACKGROUND OF THE INVENTION

1. Field of the Invention

The present invention relates to methods and techniques for the fractionation of wood and herbaceous biomass. More particularly, this invention relates to methods and techniques for separating wood and biomass into three major components for further processing.

2. Description of the Prior Art

Pulping processes have previously been used for separating cellulose from lignin and other components of lignocellulosic materials. For example, various types of inorganic chemicals in water have been used to modify lignin to render it water soluble. Those processes, however, present problems in recovering or destroying the inorganic chemicals.

Other processes have been proposed using organic solvents for dissolving the lignin from the lignocellulosic material. Such processes can be expensive because of the cost of solvent recovery.

Still other processes have involved combinations of acids and alcohols with water. However, the presence of excess water can be detrimental to the process, and use of high concentrations of acid require costly recovery systems.

U.S. Pat. No. 2,037,001 (Aronovsky) describes an extraction process involving a two component aqueous alcoholic liquor. Lignin is separated from the aqueous stream by cooling the pulping liquid to ambient temperature following digestion and allowing the liquor to phase separate. The dissolved lignin is carried with the alcohol while any dissolved sugars remain in the aqueous liquor. The purity of lignin products isolated from processes using alcohols is not as high as is desired. An impure lignin isolated from alcohol requires extensive and expensive purification. Also, use of cooling temperatures for phase separation of the liquor could lead to re-deposition of lignin on the fibers.

U.S. Pat. No. 1,594,389 (Thellier) deals with the removal of extractives from flax and similar plants using a water/hydrocarbon mixture. This extraction would not remove any of the structural components of the flax nor would it result in the fractionation of the material due to the low concentration of the hydrocarbon which would remain soluble in the water.

U.S. Pat. No. 1,888,025 (Bent) describes a process in which wood or lignocellulosic material is extracted with aqueous organic solvents followed by the recovery of relatively hydrophobic extractives into an immiscible hydrophobic solvent. The patent deals with the removal of rosin from wood—essentially an extractive in pine wood—with an aqueous alcoholic solvent followed by a liquid/liquid extraction of the rosin from the solvent rather than the separation of biomass into structural polymer components.

U.S. Pat. No. 2,024,689 (Groombridge) refers to the use of mixtures of organic compounds with water for the separation of cellulose from the noncellulosic material in lignocellulosic feedstocks. However, there is no description of the use of a water-immiscible organic compound, water and a water-soluble organic compound to effect this separation.

U.S. Pat. No. 2,042,705 (Dreyfus) describes a process very similar to Groombridge, above, with the addition of water to the solvent mixture. There is no description of the separation of the pulping liquor into a lignin-rich component and a hemicellulose-rich component.

U.S. Pat. No. 3,932,207 (Fogarassy) describes a process in which, prior to cooking, fragments of raw lignocellulosic material are impregnated with a solution of a lignin-solubilizing reactant in an organic solvent with a boiling point higher than the cooking temperature. Then the impregnated material is immersed in a liquid which is immiscible with the solvent of the solution.

U.S. Pat. No. 4,520,105 (Sinner) describes a process involving a chemical pretreatment with a mixture of water and lower alcohols or acetone, after which the residue is separated and then treated with a similar solvent mixture at elevated temperature. However, alcohol or acetone mixtures with water cannot be separated into two phases. Also, separation of the lignin from dissolved sugars would require further processing through extensive washing.

U.S. Pat. No. 4,594,130 (Chang) describes a cooking process, in the absence of oxygen, at elevated temperatures with a neutral or acidic mixture of alcohol and water containing a magnesium, calcium or barium salt as a catalyst. The catalyst is for the purpose of aiding retention of the hemicellulose in the cellulosic cake.

European Patent Application 86305606.5 (Biodyne) describes a process for digesting lignocellulosic material with an ester, an organic lignin solvent and water. The lignin solvent is either an organic acid or alcohol or mixtures thereof, and it is miscible in both the ester and the water. Cooling of the liquor apparently results in some phase separation, but a centrifuge is also required.

There has not heretofore been described an efficient process involving the use of a single phase cooking liquor which can be readily separated into two liquid phases when desired.

SUMMARY OF THE INVENTION

It is an object of the invention to provide a process for separating wood and herbaceous biomass into its three major components for further processing.

It is an object of the invention to provide a convenient and efficient process for separating lignocellulosic material into lignin, cellulose, hemicellulose and sugars.

It is another object of the invention to provide a process for separating lignocellulosic material into its three major components using either a batch process or a continuous process.

It is yet another object of the invention to provide a very pure lignin stream in a process for fractionating lignocellulosic material.

It is still another object of this invention to provide a cellulose stream free of re-precipitated lignin in a process for fractionating lignocellulosic material.

Additional objects, advantages, and novel features of the invention shall be set forth in part in the description that follows and in part will become apparent to those skilled in the art upon examination of the following or may be learned by the practice of the invention. The objects and the advantages of the invention may be realized and attained by means of the instrumentalities and in combinations particularly pointed out in the appended claims.

To achieve the foregoing and other objects and in accordance with the purpose of the present invention, as embodied and broadly described herein, the improved methods may comprise separating lignocellulosic material into lignin, (b) cellulose, and (c) hemicellulose and sugars. In one embodiment the method comprises:

(a) digesting the lignocellulosic material in a single-phase mixture of alcohol, water and a water-immiscible organic solvent selected from the group consisting of ketones;

(b) adjusting the amount of water in said mixture to cause phase separation;

(c) separating said mixture into first, second and third phases; wherein said first phase comprises lignin and said organic solvent, said second phase comprises solid cellulosic cake, and said third phase is an aqueous alcoholic mixture and comprises hemicellulose and dissolved sugars.

The methods and techniques provided by this invention enable wood or herbaceous biomass to be fractionated very efficiently in a single phase, after which the pulping mixture can be separated into separate phases wherein the lignin is present in a homogeneous organic phase, the hemicellulose and sugars are present in the aqueous phase, and cellulose is present as a solid cellulosic cake. The organic phase can be separated, and the lignin can be isolated by evaporation of the organic solvent. The isolated lignin is substantially free of sugars.

The separate components of the wood and herbaceous biomass can be used for further desired processing. For example, the cellulose can be used for making paper and paperboard products or ethanol. It can also be used for making cellulose derivatives such as cellulose esters. The lignin can be used as a feedstock for phenolics, enhanced oil recovery surfactants, or fuel additives. The hemicellulose can be used making ethanol or other chemicals.

Other advantages of the methods of this invention will be apparent from the following detailed description.

DETAILED DESCRIPTION OF THE INVENTION

The improved methods of this invention involve placing the lignocellulosic material (e.g., wood or herbaceous biomass) in a suitable reactor, after which a mixture of solvents and water are added. It is necessary to obtain a single phase mixture.

A water-insoluble or water-immiscible organic solvent is used which is a ketone. A water-soluble or miscible alcohol and water are also used. Preferably the ketone is an aliphatic ketone having at least 4 carbon atoms (and may have as many as 10 carbon atoms). The alcohol preferably has less than about 4 carbon atoms to assure that it will be water-miscible.

Useful aliphatic ketones include, for example, methyl ethyl ketone, methyl isopropyl ketone, methyl propyl ketone, methyl butyl ketone, methyl isobutyl ketone, methyl isoamylketone, diethyl ketone, ethyl isopropyl ketone, ethyl propyl ketone, and ethyl isobutyl ketone. Useful alcohols include methanol, ethanol, propanol, isopropanol and butanol.

Typically the ketone is present in the solvent system in an amount of about 7 to 65% by weight, and water is present in an amount of about 10 to 65% by weight. The alcohol is typically present in an amount of about 25 to 35% by weight. The weight ratio of ketone to water is preferably in the range of about 1:9 to 6.5:1, so long as a single phase of digesting liquid is obtained.

Typically, the weight ratio of liquor to wood or biomass is at least about 4:1 and could be much greater if desired, e.g., 8:1 or 10:1.

The digestion is preferably carried out at an elevated temperature. Typically the digestion mixture is heated in the reactor to a temperature in the range of about 100° to 220° C. Some types of biomass can be digested more quickly than other types. If desired, a concept called severity may be used to determine the length of time required to obtain complete digestion of a particular biomass. The term severity involves use of an empirically derived equation relating time at temperature and the temperature above a base temperature at which reaction does not occur. The concept and the equation are explained in *Organosolv Pretreatment for Enzymatic Hydrolysis of Poplars. 2. Catalyst Effects and the Combined Severity Parameter,* H. L. Chum, D. K. Johnson, and S. K. Black, I & EC Research, 1990, 29, 156–162, incorporated herein by reference.

After the digestion has been completed, the single phase can be easily converted into two liquid phases upon the addition of either water or water-immiscible solvent. The two phases have very little cross-contamination of components from one phase into the other. The lignin stream is very pure and is easily isolated by evaporation of the organic solvent which is water-immiscible. The cellulosic stream obtained is free of re-precipitated lignin because the lignin and other dissolved materials remain in solution at all temperatures of the reaction. The lignin and hemicellulose are dissolved away from the wood chips leaving an insoluble cellulosic cake.

An acid catalyst is added to reduce the reaction temperature from about 200° C. for uncatalyzed cooks to 140° C. for a catalyzed cook. It also reduces the amount of time required. The catalysts used are mineral acids such as sulfuric or phosphoric acid. Nitric acid may also be used but it is not as effective. The amount of catalyst used varies with the feedstock but is generally in the range of 0.025M to 0.2M (0.2 to 2 wt % of the liquor used).

The processes of this invention are useful for fractionating all types of lignocellulosic material into separate components. For example, the processes may be used in connection with wood and herbaceous derived materials such as sugar cane bagasse, switch grass, and legumes.

EXAMPLE 1

Poplar wood chips (13.7 g oven-dried equivalent) were charged into a 200 ml batch reactor. A single phase pulping liquor composed of 24% water, 44% methyl isobutyl ketone (MIBK) and 32% ethanol with a 0.05 M $H_2SO_4$ catalyst was added in a ratio of 10 parts liquor to 1 part wood. The reactor was placed in a preheated heating block. The reactor was held at 140° C. for 56 minutes after a 34 minute heat-up time. Severity of the reaction was 4.3. The resulting pulp was fiberized in a Waring blender and washed with fresh neutral liquor. The oven-dried equivalent yield of pulp was 64%. Kappa number for this pulp was measured at 72.

Water was added to the liquor in a ratio of 1.3 parts water to 1 part liquor to cause phase separation of the insoluble MIBK component. Lignin was isolated from the MIBK phase by evaporation with a yield of 18%. Klason lignin analysis of this lignin gave a 88% purity.

Dissolved sugars composed mostly of hemicellulose were contained in the combined alcohol-aqueous fraction in a 18% yield based on the wood charged.

EXAMPLE 2

Under the same conditions as above, 14.4 g of oven-dried equivalent weight poplar was charged into a batch reactor. A $H_2SO_4$ catalyst at a 0.1M concentration was added. The yield of pulp was 53% with a Kappa number of 46. The lignin yield was 23% with a purity of 92%. The yield of the hemicellulose fraction was 24%.

EXAMPLE 3

Aspen chips (193 g, oven-dried equivalent) were charged into a 1.7 liter percolation reactor. The reactor was filled with a MIBK/ethanol/water mixture containing 16% MIBK, 34% ethanol and 50% water containing 0.025M $H_2SO_4$. The reactor was heated to 140° C. over 34 minutes without flow of solvent. When the pulping temperature was reached, pulping solvent of the same composition was pumped through the chip bed at a flow rate of 28 ml/min. for 56 minutes. The chips were then washed in the reactor with neutral solvent at the same flow rate for 60 minutes without heating. Total severity for the reaction was 4.27. The reactor was drained, the chips fiberized and the lignin separated as described above. The pulp yield was 52% with a Kappa of 28. Lignin was isolated in a 17% yield. Hemicellulose yield was 31%.

EXAMPLE 4

Poplar chips from undebarked logs (189 g, oven-dried equivalent) were pulped under the same conditions as example 3 except for a 0.1 M $H_2SO_4$ catalyst concentration. Severity for this run was 4.27. The pulp yield was 45% with a Kappa of 42. Lignin was isolated in a 22% yield at a purity of 93%. Hemicellulose yield was 33%.

EXAMPLE 5

Depithed sugar cane bagasse (72 g, oven-dried equivalent) was pulped under the same conditions as example 4. The solvent mixture used was the same as that of example 1. Severity was 4.23. The yield of pulp was 49% with a Kappa of 8. The yield of lignin was 32%. Yield of hemicellulose was 19%.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to falling within the scope of the invention as defined by the claims which follow. The embodiments of the invention in which an exclusive property or privilege is claimed are defined as follows:

What is claimed is:

1. A method for separating lignocellulosic material into lignin, cellulose, and dissolved sugars composed mostly of hemicellulose and sugars, the method comprising: the steps of:

(a) digesting the solid lignocellulosic material in a single phase mixture of an alcohol, water and a water-immiscible ketone having at least 4 carbon atoms to solubilize lignin and hemicellulose and leave a cellulosic solid phase; said water being present in said single phase mixture in an amount of about 10 to 65 percent by weight, and said water-immiscible ketone being present in an amount of about 7 to about 65% by weight;

(b) adjusting the amount of water in said single liquid phase mixture to cause phase separation into two liquid phases of a lignin water-immiscible ketone stream and a stream of dissolved sugars composed mostly of hemicellulose; and (c) separating said mixture into first, second and third phases; wherein said first phase is a liquid and comprises high purity lignin by evaporating water-immiscible ketone; said second phase comprises high purity cellulose in a solid phase; and said third phase is aqueous and comprises hemicellulose and dissolved sugars.

2. A method in accordance with claim 1, wherein said digesting is carried out at a temperature in the range of about 135° C. to 220° C.

3. A method in accordance with claim 1, wherein said ketone is selected from the group consisting of methyl isobutyl ketone, methyl isopropyl ketone methyl isoamyl ketone.

4. A method in accordance with claim 1, wherein said alcohol has 1–4 carbon atoms.

5. A method in accordance with claim 1, wherein said single phase mixture further comprises an acid catalyst.

6. A method in accordance with claim 5, wherein said acid catalyst comprises a mineral acid which is present in an amount about 0.2 to 2% by weight.

7. A method in accordance with claim 6, wherein said catalyst is selected from the group consisting of sulfuric acid and phosphoric acid.

8. A method for separating lignocellulosic material into lignin, cellulose, and dissolved sugars composed mostly of hemicellulose and sugars, the method comprising: the steps of:

(a) digesting lignocellulosic material in a single phase mixture of an alcohol, water and a water-immiscible ketone having at least 4 carbon atoms to solubilize lignin and hemicellulose and leave a cellulose solid phase; said water being present in said single phase mixture in an amount of about 10 to 65 percent by weight, and said water-immisible ketone being present in an amount of about 7 to about 65% by weight;

(b) adjusting the amount of said ketone in said single liquid phase mixture to cause phase separation into two liquid phases of a lignin water-immiscible ketone stream and a stream of dissolved sugars composed mostly of hemicellulose; and (c) separating said mixture into first, second and third phases; wherein said first phase is liquid and comprises high purity lignin by evaporating water immiscible ketone said second phase comprises high purity cellulose in a solid phase; and said third phase is an aqueous alcohol mixture and comprises hemicellulose and dissolved sugars.

* * * * *